United States Patent [19]

Nussbaum

[11] 3,965,650

[45] June 29, 1976

[54] HIGH SPEED CASE PACKING MACHINE

[75] Inventor: Herbert H. Nussbaum, Bainbridge, Ga.

[73] Assignee: Miller Hydro Company, Bainbridge, Ga.

[22] Filed: Jan. 13, 1975

[21] Appl. No.: 540,606

[52] U.S. Cl. ..... 53/166; 53/61; 53/248

[51] Int. Cl.[2] ..... B65B 5/08; B65B 21/06; B65B 21/16

[58] Field of Search ..... 53/61, 62, 159, 166, 53/247, 248, 251; 198/21, 22 B

[56] References Cited

UNITED STATES PATENTS

| | | | |
|---|---|---|---|
| 3,008,563 | 11/1961 | Carter | 53/166 X |
| 3,052,071 | 9/1962 | Copping | 53/62 |
| 3,340,676 | 9/1967 | Arnett | 53/166 X |
| 3,479,791 | 11/1969 | Wild | 53/61 |
| 3,546,837 | 12/1970 | Shuttleworth | 53/166 X |
| 3,561,189 | 2/1971 | Raudat | 53/166 X |
| 3,592,002 | 7/1971 | Alduk | 53/166 X |

*Primary Examiner*—Robert L. Spruill
*Attorney, Agent, or Firm*—Lockwood, Dewey, Zickert & Alex

[57] ABSTRACT

A machine for packing bottles and other containers in an underlying carton includes a packing station having a removable drop plate assembly for transferring the containers in groups from parallel side-by-side rows into desired packing positions in the carton. The drop plate assembly includes a plurality of drop bar assemblies disposed under and aligned with respective ones of the rows of containers. The drop bar assemblies each include a drive chain which frictionally engages the containers to advance the containers into predetermined pre-packing positions corresponding to the desired packing positions in the carton. After the containers have advanced to the pre-packing positions, the drop plate assembly is shifted so as to position the drop bar assemblies between the rows to allow the containers to fall into the underlying carton. Alternate links of each drive chain preferably have alignment tabs slidably engaged in channels in a central support bar included in each drop bar assembly to enable the drop bar assemblies to be as narrow as the drive chain. Power is preferably supplied to the removable drop plate assembly either by means of a spur gear having a beveled leading edge for meshing with a drive gear in the packing station, or by means of a motor mounted on the drop plate assembly.

12 Claims, 19 Drawing Figures

20
21
22
22a
23
24
25
26
27
28
30
31
32
33
34
35
40
50
58
106
120
121

26
31
36
37
21c
50
83
84
107
110
112
120
121
122

26
31
36
37
21a
21c
50
83
84
107
110
112
120
121
122

26
31
36
37
21
21a
64
50
83
84
107
110
112
120
121
122

HIGH SPEED CASE PACKING MACHINE

BACKGROUND OF THE INVENTION

The present invention relates in general to packing machines, and more particularly to machines for automatically packing bottles, cans or similar containers in predetermined positions in wooden or cardboard cartons.

Automatic in-line type packing machines have come into wide use for high-speed packing of bottles and other containers in compartmentized or non-compartmentized cartons. Such machines generally utilize a conveyor belt to advance the containers to be packed in side-by-side rows to a packing station, wherein they are aligned in a precise grid pattern and dropped as a group into a carton positioned below. While a conventional conveyor belt can be used to advance the containers prior to packing, the line pressure exerted on the containers being positioned for packing by the trailing containers on the conveyor belt can result in undesirable distortion or jamming, or even breakage, of odd-shaped, flexible or thin-walled containers, making the precise grid pattern alignment required in the packing station for precision high-speed packing difficult to consistently obtain.

One in-line packing machine particularly well adapted for packing flexible and odd-shaped bottles is the model RG case packer manufactured and marketed by Miller Hydro Company, the assignee of the present application. This machine incorporates in its packing station a container drop assembly which includes power driven drop bar assemblies under row of containers to advance the containers into their pre-packing positions independently of the pressure exerted by the conveyor on trailing containers. A container clamping station upline of the packing station effectively restrains the trailing containers in each row prior to their entering the packing station to prevent line pressure developed by the trailing containers from being applied to the containers as they are being aligned by the power driven drop bar assemblies. To release the containers from the packing station the drop bar assemblies are shifted to positions between the rows of containers so that the containers are free to drop into their respective positions in the carton positioned below. The present application is directed to improvements in the packing station, and more specifically to improvements in the container drop assembly and the means for supplying power thereto.

Accordingly, it is a general object of the present invention to provide a new and improved machine for automatically and efficiently packing containers in a case.

It is a more specific object of the present invention to provide a new and improved packing machine for packing containers in a case which provides faster and more accurate handling of odd-shaped and flexible containers.

It is another object of the present invention to provide an improved container drop assembly for use in the packing station of an automatic case packing machine.

It is another object of the present invention to provide an improved container drop assembly which can be more easily installed and removed from a case packing machine to allow the machine to more readily accommodate different sizes and shapes of containers.

SUMMARY OF THE INVENTION

The invention is directed, in an in-line packing machine of the type wherein containers to be packed are advanced in side-by-side channels, to a packing station for transferring containers from the channels to desired packing positions in an underlying carton. The packing station comprises a plurality of drop bar assemblies underlying respective ones of the container channels, these drop bar assemblies each including a continuous loop drive chain presenting an upwardly-facing surface for frictionally engaging the containers, the overall width of these drop bar assemblies not exceeding that of the drive chain. Means are provided for powering the drive chains to advance the containers in each of the channels to the predetermined packing positions, and means for shifting the drive bar assemblies from positions under the channels to positions between the channels after the containers have arrived at the predetermined pre-packing positions are provided to allow the containers to drop into the underlying carton.

The invention is further directed, in an in-line packing machine of the type having a plurality of side-by-side channels for conveying containers to be packed and including a conveyor belt for advancing the containers along the channels, to a packing station for receiving the containers in a defined group from the conveyor and for transferring the containers from the channels to desired packing positions in an underlying carton. The packing station comprises a plurality of drop bar assemblies underlying and aligned with respective ones of the container channels, these drop bar assemblies each including a support bar having a guide channel on the top surface thereof and a continuous loop drive chain presenting a support surface for frictionally engaging the containers in the packing station and including links having projecting portions slidably received in the channel to maintain the chain in alignment. Means are provided for powering the drive chains to advance the containers along the channels into predetermined pre-packing positions in the packing station corresponding to the desired packing positions in the underlying carton, and means including a plurality of container stop assemblies in respective ones of the channels are provided for receiving the containers in abutting relationship, these stop assemblies having a pre-packing position such that the lead containers in each channel abut the stop assemblies when the containers in the group are in the predetermined pre-packing positions. Means are further provided for shifting the drop bar assemblies from under the channels after the containers have advanced against the stop assemblies to allow the containers to drop into the underlying carton.

The invention is further directed, in an in-line packing machine of the type wherein containers to be packed are advanced in side-by-side channels, to a packing station for transferring containers from the channels to desired packing positions in an underlying carton. The packing station comprises a plurality of drop bar assemblies underlying respective ones of the container channels, these drop bar assemblies comprising part of a drop plate assembly removable from the packing station and each including a continuous-loop drive chain or belt presenting an upwardly-facing surface for frictionally engaging the containers. Drive means are provided for powering the drive chains or belts to advance the containers in each of the channels to the predetermined packing positions, these drive means including a drive gear on the frame of the packing machine and a spur gear on the drop plate assembly operatively engaged thereto, one of these gears having a beveled circumferential edge facing the other of the gears to facilitate engaging and disengaging the gears when inserting and removing the drop plate assembly. Means are further provided for shifting the drop plate assembly to remove the drive bar assembly from positions under the channels after the containers have arrived at the predetermined pre-packing positions to allow the containers to drop into the underlying carton.

The invention is further directed, in an in-line packing machine of the type wherein containers to be packed are advanced in side-by-side channels, to a packing station for transferring containers from the channels to desired packing positions in an underlying carton. The packing station comprises a plurality of drop bar assemblies underlying respective ones of the container channels, these drop bar assemblies comprising part of a drop plate assembly removable from the packing station and each including a continuous-loop drive chain or belt presenting an upwardly facing surface for frictionally engaging the containers. Drive means including a motor mounted on the drop plate assembly are provided for powering the drive chains or belts to advance the containers in each of the channels to the predetermined packing positions, and means are also provided for shifting the drop plate assembly to remove the drive bar assemblies from positions under the channels after the containers have arrived at the predetermined pre-packing positions to allow the containers to drop into the underlying carton.

BRIEF DESCRIPTION OF THE DRAWINGS

The features of the present invention, which are believed to be novel, are set forth with particularity in the appended claims. The invention, together with the further objects and advantages thereof, may best be understood by reference to the following description taken in connection with the accompanying drawings, in the several figures of which like reference numerals identify like elements, and in which:

DESCRIPTION OF THE PREFERRED EMBODIMENT

Figure 1:
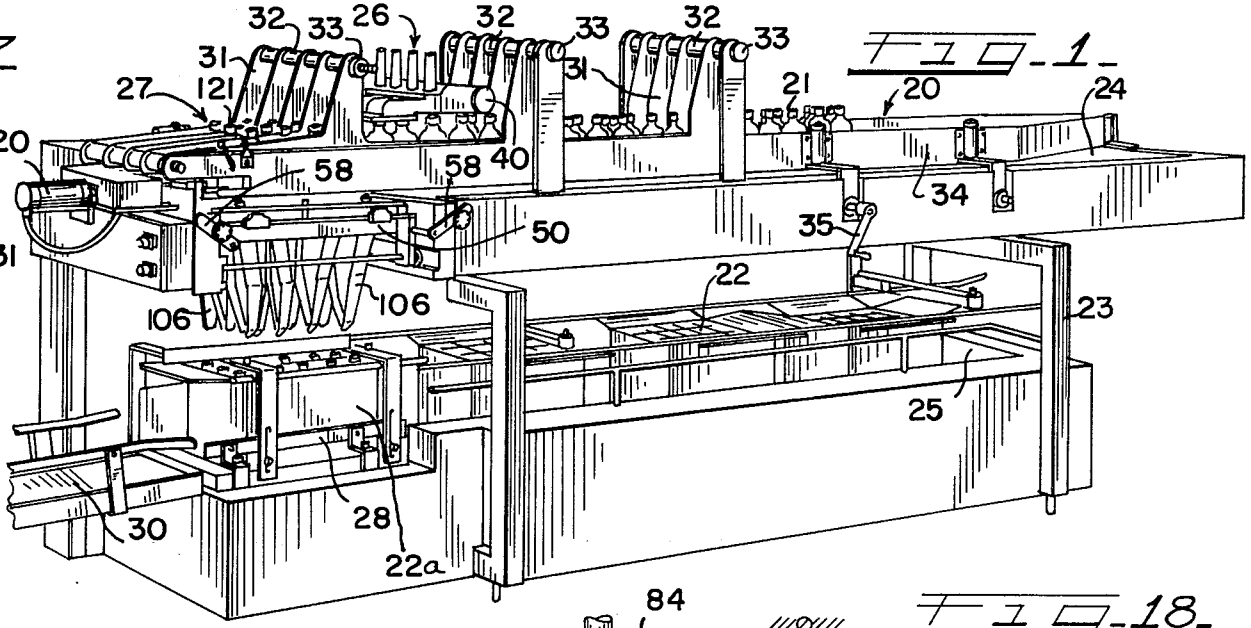
FIG. 1 is a perspective view of a container packing machine constructed in accordance with the invention.

Referring to FIG. 1, the invention is shown incorporated in an in-line packing machine 20, which provides efficient high-speed packing of containers 21 in compartmentized or non-compartmentized cardboard or wooden cartons 22. Basically, packing machine 20 comprises a frame 23 which supports an elevated container in-feed conveyor 24 and an underlying carton in-feed conveyor 25. In operation, containers to be packed are advanced by conveyor 24 past a clamping station 26 to a packing station 27. There, the containers are aligned in a grid pattern corresponding to their ultimate packed positions and dropped as a group into an underlying carton 22*a* which has been advanced by conveyor 25 and raised into position beneath the packing station by means of a carton lift table 28. The carton is then transferred from the lift table to a carton out-feed conveyor 30, which transports the loaded carton away as another carton enters the lift table from conveyor 25 in preparation for the next packing operation.

In the illustrated embodiment the packing machine is set up to pack 24 containers in four rows of six containers each, and the containers in this instance are advanced by conveyor 24 in four parallel rows or channels, as defined by five transversely-spaced longitudinally-extending guide plates 31. The spacing between the guide plates 31 is maintained by means of a plurality of dowel-shaped spacers 32 (FIG. 1) carried on support rods 33 which extend between the guide plates 31 and frame 23 at locations above the tops of the containers. A pair of agitator rails 34, disposed on opposite sides of the container in-feed conveyor 24 and having a spacing operator-adjustable from the front of the packing machine by means of a crank 35, are preferably provided near the head end of the conveyor to aid in distributing the containers 21 evenly among the four rows or channels. It will be appreciated that while four rows of containers are illustrated, a greater or lesser number could be provided by merely utilizing a greater or lesser number of guide plates 31 in appropriate positions on support rods 33. Furthermore, by changing the length of the spacers 32 between the guide plates containers of other widths or shapes can be accommodated. In practice, the speed of conveyor 24 is also made variable by using a variable-speed gear box or motor to accommodate the various packing conditions.

Figure 2:
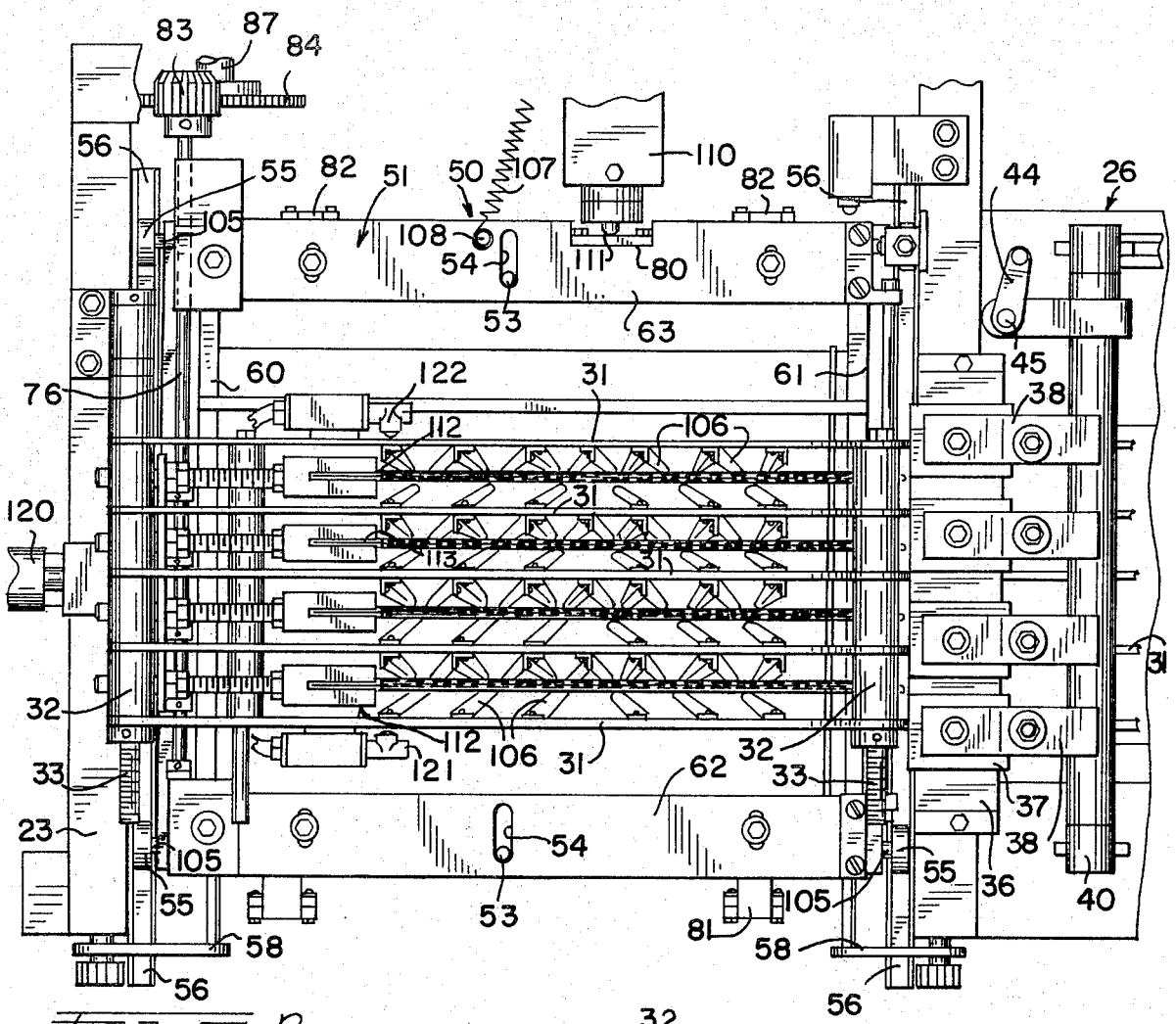
FIG. 2 is an enlarged top plan view of the container clamping and packing stations of the packing machine showing the container drop assembly in its closed position for receiving containers.
Figure 3:
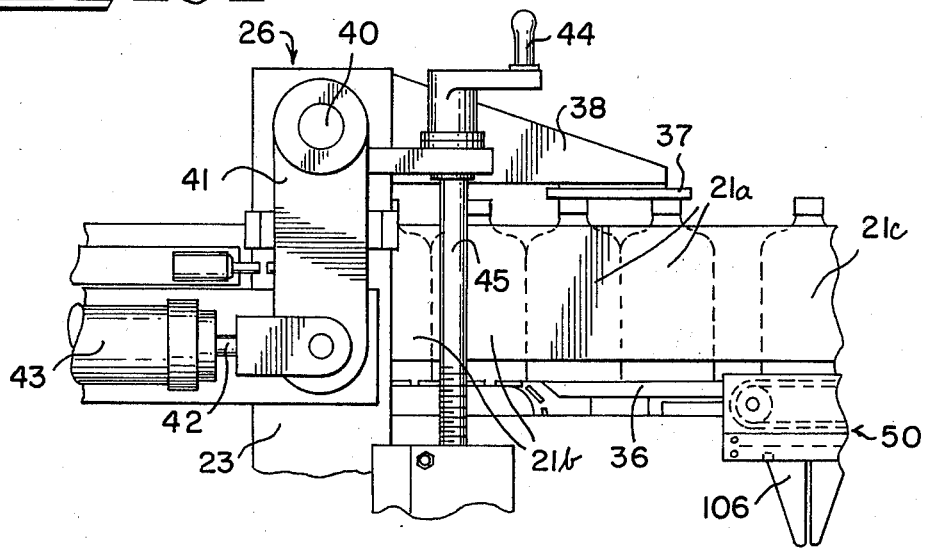
FIG. 3 is an enlarged side elevational view of the clamping station of the packing machine.

Prior to reaching packing station 27, the containers 21 pass through retardation means in the form of a clamping station 26, which, when actuated, prevents the containers from advancing further. As shown in FIGS. 2 and 3, clamping station 26 includes a dead plate 36 adjacent the discharge end of conveyor 24 onto which the lead containers 21*a* in each row are urged by the trailing containers 21*b* still on the conveyor, and a plurality of clamp pads 37 which may be brought to bear down on the tops of the containers 21*a* to hold these containers on the dead plate. Clamping pads 37 are mounted on respective ones of four actuator arms 38 which are fastened to a transversely-extending actuator shaft 40. The rear end of shaft 40 (as viewed in FIG. 2) is attached to one end of a crank arm 41, the other end of which is pivotably connected to the actuator arm 42 of a pneumatic actuator cylinder 43. When cylinder 43 is actuated, shaft 40 rotates clockwise (as viewed in FIG. 3) and the clamping pads 37 are brought to bear against the tops of the containers 21*a* on dead plate 36, preventing further forward motion of these containers and the containers 21*b* trailing behind on conveyor 24. Adjustment for containers of different heights is accomplished by means of an operator-accessible crank 44 which sets the limit of rotation of actuator shaft 40 by means of a lead-screw 45 extending to the machine frame 23. It will be appreciated that although one clamp pad 37 is shown for each row of containers, a single clamp pad may be provided instead to simultaneously clamp all four rows of containers.

Figure 5:
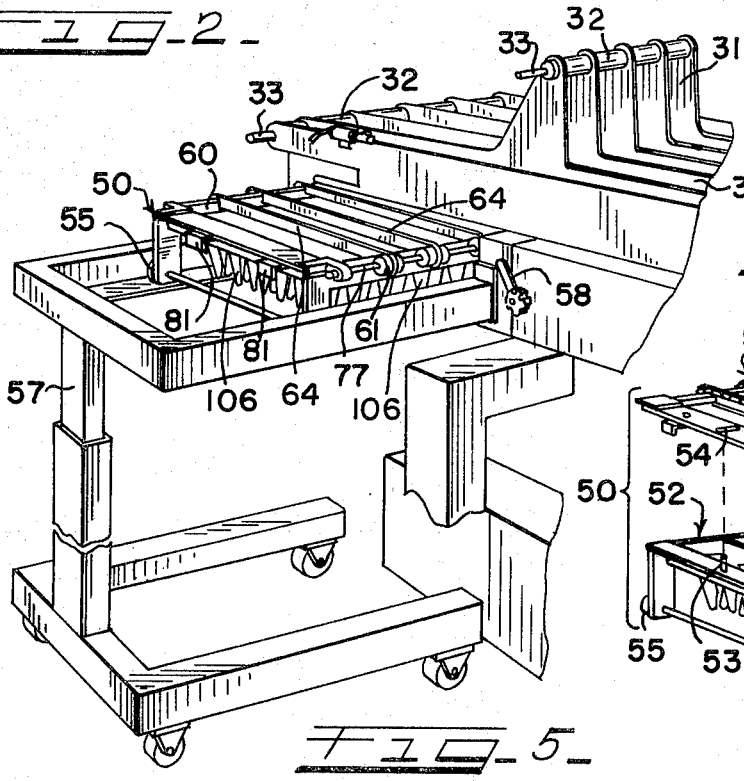
FIG. 5 is a perspective view of the container drop assembly partially removed from the packing machine and positioned on a transport dolley.
Figure 4:
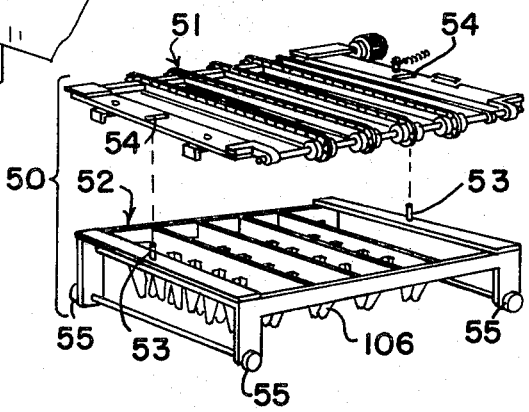
FIG. 4 is a perspective view of the container drop assembly exploded to show the drop plate and spring frame assemblies incorporated therein.

When not restrained in clamping station 26 the containers 21*c* in each row advance across the clamping station to packing station 27 by reason of the force exerted on the leading containers by the trailing containers in that row still on conveyor 24. While this force could be relied upon to advance the containers 21*c* into their desired pre-packing positions in the packing station, it has been found, as stated earlier, that the force exerted by the trailing containers may cause undesirable deformataion of thin-walled, deformable or odd-shaped bottles which may make high-speed precision packing difficult to achieve. Accordingly, packing station 27 incorporates a power drive container drop assembly 50 which positions and drops the containers 21*c* independently of any force exerted by trailing containers. Referring to FIG. 4, this container drop assembly comprises a drop plate assembly 51 and a spring frame assembly 52. The drop plate assembly 51 is slidably mounted on the spring frame assembly 52 and held in alignment with respect thereto by means of a pair of upwardly projecting guide pins 53 located on opposite sides of the spring frame assembly and a pair of complementarily positioned slot-shaped apertures 54 in the frame of the drop plate assembly. The two assemblies, when joined to form the container drop assembly 50, can be removed from the machine as a single unit, as shown in FIG. 5. To this end, spring frame assembly 52 is preferably provided with rollers 55 transversely aligned to the packing machine at each of its corners. These rollers engage appropriately positioned rails or channels 56 (FIG. 2) on the machine frame 23 so that the entire unit 50 can be rolled out of the packing machine 20 and onto a transport dolley 57 or other suitable support or storage means. This feature is particularly desirable where the set-up, i.e. the width and spacing of the container rows and the final pre-packing positions of the containers, must be frequently changed to accommodate different sizes or shapes of containers. Once the container drop assembly has been rolled onto dolley 57, the dolley can be transported to another location in the plant and the container drop assembly 50 easily transferred to another machine or to a storage rack.

When container drop assembly 50 is installed in the packing stations of the packing machine as shown in FIG. 2, the spring frame assembly 52 is locked in position to the machine frame 23 by means of a pair of operator-actuable latching assemblies 58, leaving the drop plate assembly 51 free to shift laterally with respect to the spring frame assembly 52 and the longitudinally-aligned rows of containers. As will be seen presently, this arrangement facilitates high-speed precision packing of the containers.

Figure 9B:
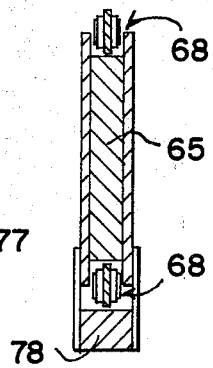
FIG. 9B is a cross-sectional view similar to FIG. 9A showing a prior-art construction of the drive bar assembly.
Figure 7:
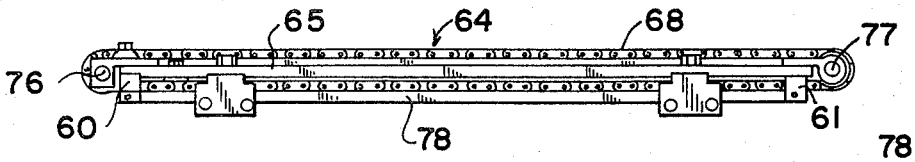
PRIOR ART FIG. 7
FIG. 7 is a front elevational view of the drop plate assembly of FIG. 6.
Figure 8:
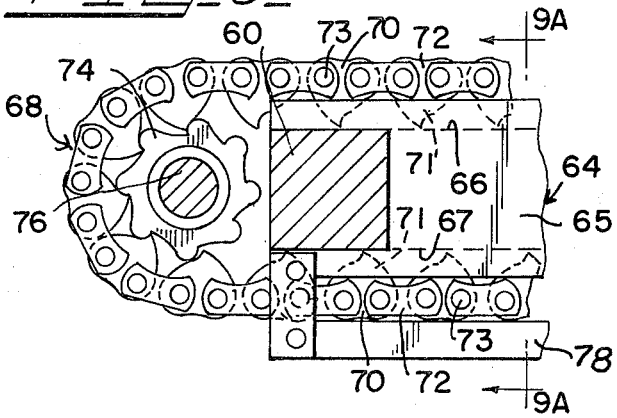
FIG. 8 is an enlarged cross-sectional view of an end portion of a drive bar assembly taken along lines 8—8 of FIG. 6.
Figure 9A:
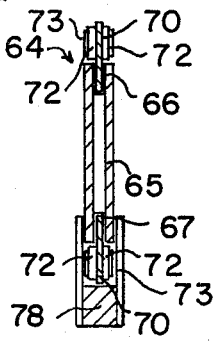
FIG. 9A is a cross-sectional view of a portion of the drive bar assembly taken along lines 9—9 of FIG. 8.

Referring to FIGS. 6–9A, the drop plate assembly 51 comprises a generally rectangular frame formed from a pair of parallel transversely-extending (with respect to the packing machine 20) members 60 and 61 and a pair of parallel longitudinally-extending member 62 and 63. A number of parallel longitudinally-extending drive bar assemblies 64 equal to the number of rows or channels of containers to be packed extend between members 60 and 61 at intervals corresponding to the center-to-center spacing of the rows. Each of these drive bar assemblies 64 consists of a central support bar or member 65 set vertically edgewise between frame members 60 and 61 and provided with upwardly and downwardly facing channels 66 and 67 on its top and bottom edges, respectively. The central support member 65 may be formed from a single bar of suitable material, or may alternatively be formed as an assembly of three different sheets of material as shown in FIGS. 9A and 9B.

To provide the desired forward movement of the containers 21*c* while in the packing station 27, each of the longitudinally-extending drive bar assemblies 64 is provided with a continuous-loop drive chain 68 extending over the top and bottom edges of support member 65. In accordance with one aspect of the invention, alternate links 70 of this drive chain include inwardly-projecting blade-shaped teeth or guide portions 71 which are received within channels 66 and 67 as these links pass over the top and bottom edges, respectively, of the central support member 65. These guide portions serve to maintain the individual links 70 of the chain in accurate lateral and vertical alignment, thereby achieving the precision positioning of the containers required for high-speed packing and allowing the central support bar 65 to be narrower than prior art designs, wherein the entire chain was slidably received within a channel on top of the bar, as shown in FIG. 9B. In practice it is desirable that the support bar 65 be as narrow as possible, since this enables the drive bar assemblies 64 to better fit between the rows of containers when the drop plate assembly 51 is shifted to drop the containers, as will be detailed presently. As can be seen in FIG. 9A, utilizing the preferred structure of the invention, the central support bar 65 and the entire drive bar assembly 64 need be no wider than drive chain 68. The links 70 are connected by means of conventional connecting links 72 which extend parallel and spaced-apart in pairs between like faces of links 70, and are pivotally attached to links 72 by means of rivets 73.

To provide end support for chain 68 toothed wheels 74 and 75 are provided at respective ends of central support members 65, adjacent from members 60 and 61, respectively. Each of the toothed wheels 74 is carried on and rotatably coupled to a drive shaft 76 which extends parallel and adjacent to frame member 60. Similarly, each of the support wheels 75 is carried on a transversely-extending shaft 77 which extends parallel and adjacent to frame member 61. The tooth surfaces provided on the end wheels 74 and 75 are appropriately spaced and shaped to operatively engage the inwardly-projecting teeth 71 of the drive chain.

The drive bar assemblies 64 may also include an underlying chain guard 78 suspended from support member 65 to prevent sagging of the drive chain 68 as it passes beneath the support member.

To assist in laterally shifting the drive plate assembly 51 during operation of the packing machine the longitudinally-extending rear frame member 63 may be provided with a flat pad or actuator surface 80 on its rearwardly-facing surface to operatively engage an actuating member (not shown in FIGS. 6–9). Also, pairs of alignment brackets 81 and 82 may be bolted to the front and rear frame members 62 and 63, respectively, to control the extent to which drop plate assembly 51 can shift with respect to spring frame assembly 52 during operation of the packing machine.

Figure 10:
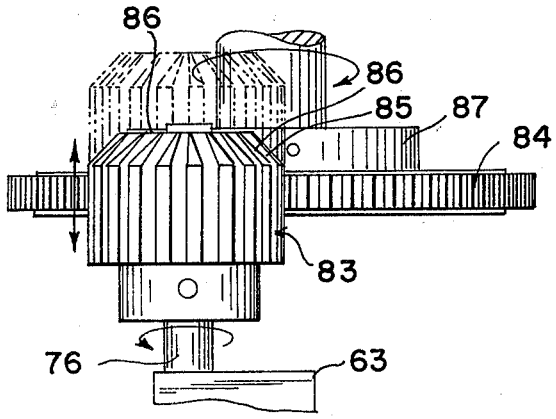
FIG. 10 is an enlarged top plan view of a preferred drive arrangement for the powered drive bar assemblies of the drop frame assembly.

In accordance with another aspect of the invention, the drive shaft 76 to which the chain-supporting wheels 74 are attached is preferably driven during operation of the packing machine by means of a spur gear 83 which has on its rear edge an inwardly beveled edge 85. Referring to FIG. 10, this gear meshes with a complementarily toothed drive gear 84 of relatively thinner dimensions. As shown by the broken lines in FIG. 10, the relatively greater thickness of spur gear 83 allows the drive chain 68 to be continuously powered, notwithstanding the lateral shifting of the drop plate assembly 51 which takes place during the packing cycle. The inwardly-tapered rearwardly-projecting beveled surface 85 on spur gear 83 facilitates the insertion of the container drop assembly 50 into packing station 27 when changing the set-up of the packing machine. Absent this beveled edge, it would be necessary to first align the tooth-receiving portions of gear 83 with the teeth of gear 84 before the container drop assembly could be installed in the machine. By reason of the rearward-divergence of the teeth-receiving recesses 86 of gear 83 the need for such alignment is largely obviated.

Figure 11:
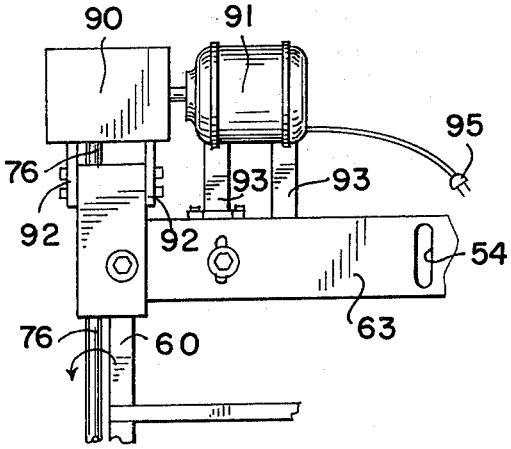
FIG. 11 is an enlarged top plan view of an alternate drive arrangement for the drive bar assemblies.

Drive gear 84 is carried on a drive shaft 87 which is preferably powered from the same source as the container in-feed conveyor 24, thus assuring synchronism between the motion of containers 21*c* on the drop plate assembly 51 and those trailing containers 21*a* and 21*b* on conveyor 24. However, in accordance with another aspect of the invention, the alternate arrangement for driving the drive chains shown in FIG. 11 may also be employed. Instead of the elongated spur gear 83 and coacting drive gear 84, a gear reduction box 90 and motor 91 may be mounted to the rear frame member 63 by means of suitable brackets 92 and 93. As the output shaft of motor 91 turns, drive shaft 76 on which the chain wheels 74 are mounted is caused to rotate to achieve the same driving action for the four chains 68 as provided by gears 83 and 84. Since this arrangement obviates the need for a drive gear 84 at packing station 27, the drive arrangement required for conveyor 24 is simplified. To maintain synchronization between the drive chains and conveyor belt 24, either motor 91 may be a variable speed type motor or the gear reduction provided by gear box 90 may be made variable. In the first instance, it is contemplated that the speed of motor 91 could be varied by either varying the frequency of the line current supplied to the motor, or by providing multiple windings or taps on the motor. Alternatively, a DC motor could be utilized in conjunction with a series-connected rheostat. In any case, it is contemplated that the control over these parameters could be combined or ganged with whatever means may be provided for controlling the speed of the container in-feed conveyor 24. Power is preferably supplied to motor 91 by means of a cable 94 fitted with an appropriate connector 95 to facilitate convenient disconnection of the motor when removing the container drop assembly 50 from the machine.

Figure 12:
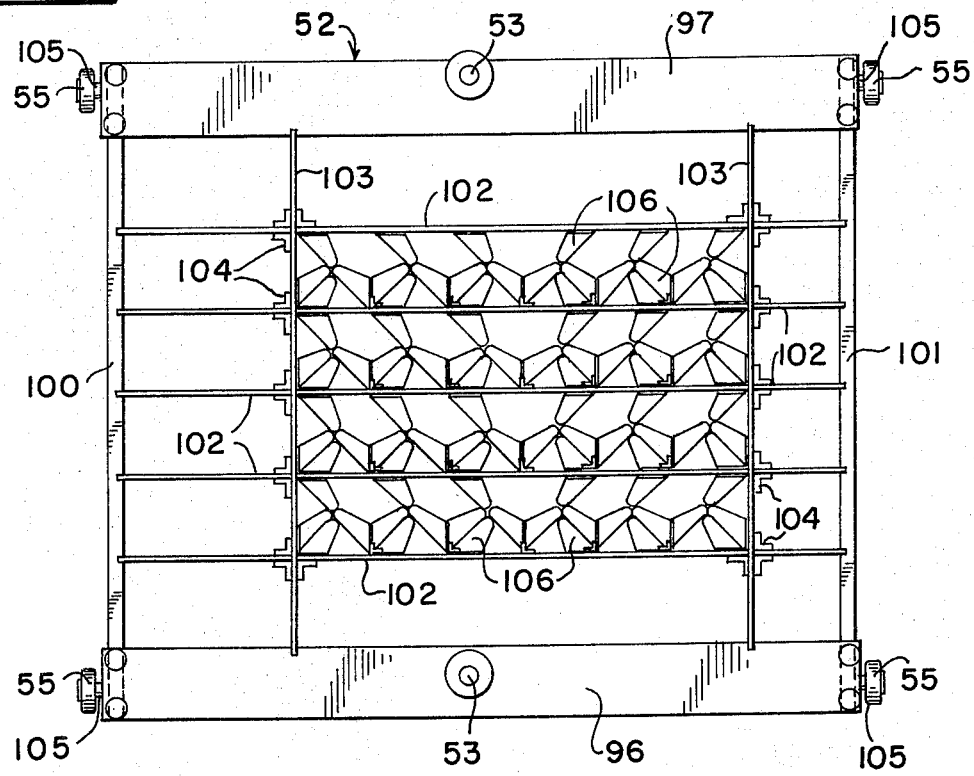
FIG. 12 is a top plan view of the spring frame assembly.
Figure 13:
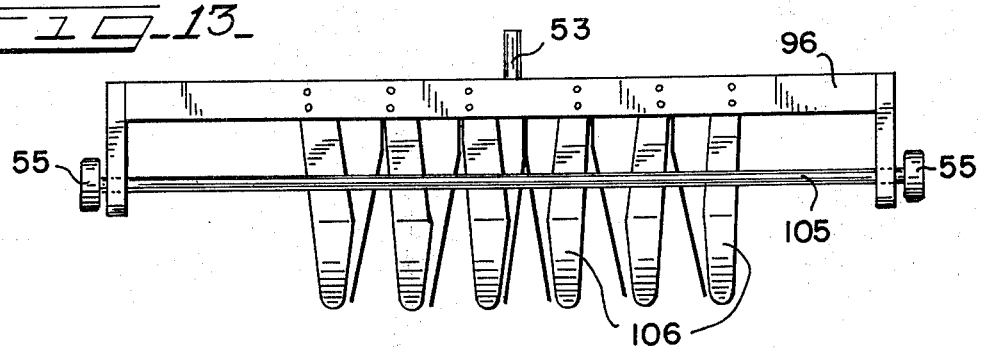
FIG. 13 is a front elevational view of the spring frame assembly of FIG. 12.

Referring to FIG. 12, the spring frame assembly 52 which underlies drop plate assembly 51 in the container drop assembly 50 consists of a pair of parallel longitudinally-extending front and rear frame members 96 and 97, respectively, joined by a pair of parallel transversely-extending vertical side plates 100 and 101. A plurality of longitudinally-extending bar-shaped spring support members 102 extend between the frame side plates 100 and 101 at locations corresponding to and underlying respective ones of the divider plates 31 which define the rows in which the containers are advanced for packing. In this instance, five support members 102 are provided at equi-spaced locations corresponding to the five divider plates 31 which divide the four rows of containers. To provide additional rigidity to the spring frame assembly 52 a pair of transversely-extending support members 103 of complementary dimensions to members 102 may be provided. It will be understood that support members 102 and 103 may actually be formed from a plurality of individual sections fastened together at their adjacent edges by appropriate means such as angle brackets 104 to achieve the desired configuration.

As detailed previously, a pair of guide pins 53 project upwardly from frame members 96 and 97 to engage the elongated slots 54 provided on frame members 62 and 63 of drop plate assembly 51 to maintain the two assemblies in precision alignment. The previously mentioned rollers 55 provided at opposite corners of spring frame assembly 52 to facilitate installation and removal of the container drop assembly 50 are mounted on longitudinally-extending shafts 105 which extend between front and rear pairs of the rollers.

To control the rate at which the containers 21 drop into the underlying carton 22*a* the spring frame assembly 52 is provided with a plurality of spring fingers 106 which depend downwardly from support members 102 and 103. These fingers are shaped and dimensioned to provide a counteracting force to the force of gravity which acts on the containers once they are released by the container drop assembly 50. To this end, the spring fingers 106 are formed inwardly toward the center of each of the predetermined container packing locations and may be provided with suitable bends or angled surfaces to provide lateral guidance to the containers as they drop. The provision of such spring members in packing machines is well known to the art and accordingly need not be covered in detail.

Referring to FIG. 2, when the container drop assembly 50 is locked in position in the packing machine, as detailed previously, the drop plate assembly 51 is free to shift laterally relative to spring frame assembly 52 and the incoming rows of containers 21. Initially, the drop plate assembly 51 is positioned rearwardly to the extent permitted by brackets 81 such that the four container support and drive bar assemblies 64 contained on the drop plate assembly are aligned beneath respective rows or channels of incoming containers. As the containers 21*c* pass through the bottle clamping station 26 by reason of the driving action of the trailing containers 21*a* and 21*b* still on conveyor 24 they become supported by these drive bar assemblies. Since the container drive bar assemblies 64 each include a continuously moving drive chain 68, the top surface of which is frictionally engaged to the bottom surface of the containers, the containers 21*c* are driven by the drive chain toward their respective pre-packing positions, independently of any pressure that may be exerted by the trailing conveyors 21*a* and 21*b* by reason of in-feed conveyor 24. The drop plate assembly 51 is held in this initial container-receiving position by means of a compression spring 107 which extends between an appropriately positioned upwardly-projecting attachment stud 108 on the rear frame member 63 of the drop plate assembly 51 and an appropriate attachment point (not shown) on the machine frame 23.

Once the incoming containers 21*c* have been advanced to their pre-packing positions in a manner which will be detailed presently, the bottle set assembly 50 in packing station 15 is caused to release the containers so that they can drop into the underlying carton 12*a*. This is accomplished by means of a pneumatic cylinder 110, which includes an actuator arm 111 arranged to bear against the strike plate 80 provided on the rear surface of drop plate assembly 51. When cylinder 110 is actuated, the actuator arm 111 pushes against strike plate 80 and shifts the drop plate assembly 51 toward the front of the packing machine, against the rearwardly-directed bias provided by compression spring 107, until further travel is limited by brackets 82. This shifts the drive bar assemblies 64 from their positions beneath containers 21*c* to positions immediately underlying the dividers 31, thus removing bottom support from the containers and allowing them to drop under the direction and retarding influence of spring members 106 into the underlying carton 22*a*.

Figure 14:
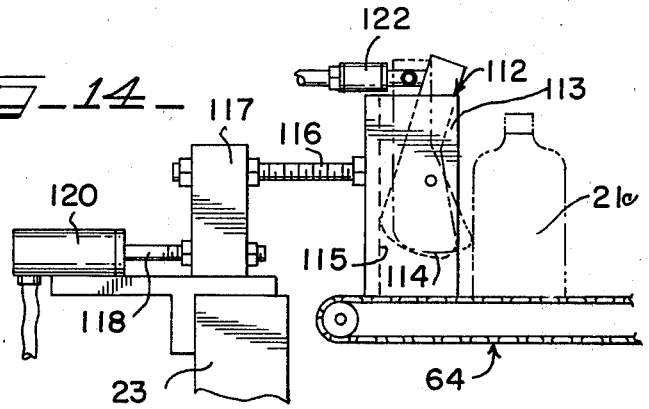
FIG. 14 is an enlarged side elevational view of the container stop assemblies incorporated in the packing station of the packing machine.
Figure 15:
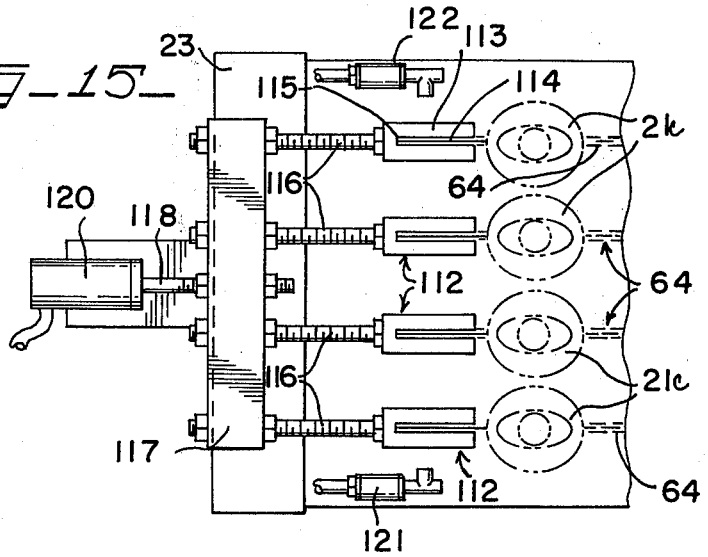
FIG. 15 is a top plan view of the container stop assemblies shown in FIG. 14.
Figure 6:
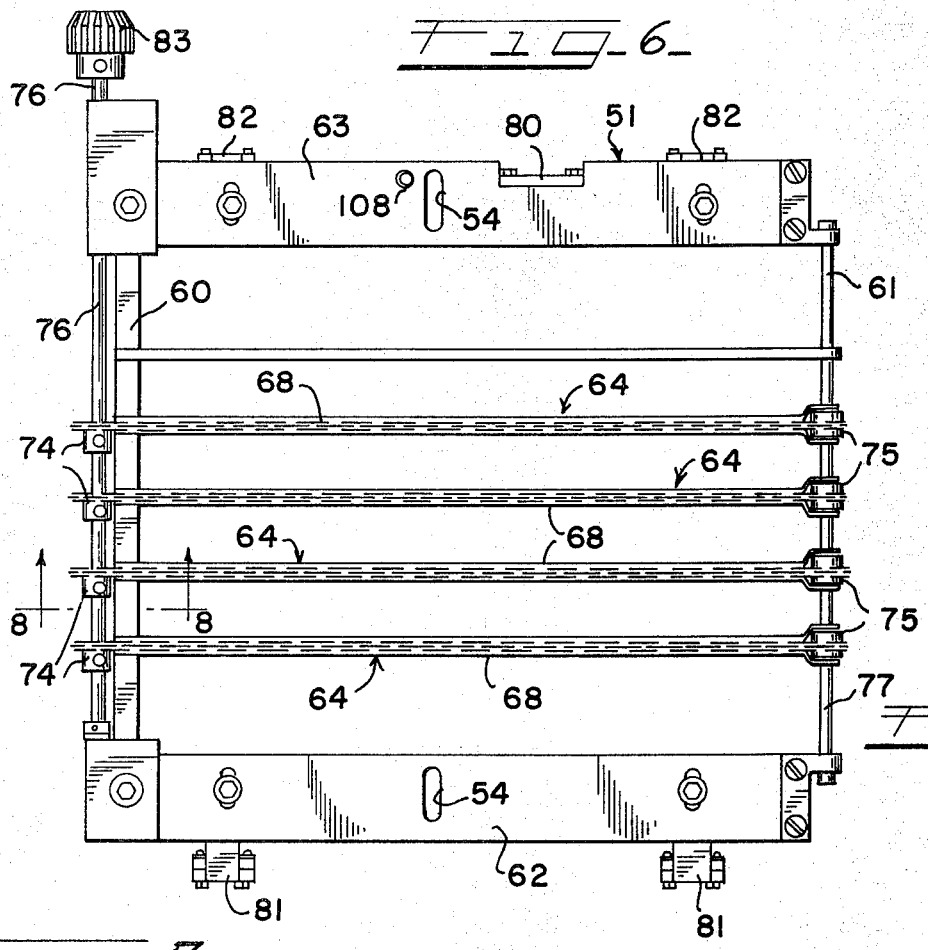
FIG. 6 is a top plan view of the drop plate assembly.

To provide the necessary precision alignment of containers 21*c* on the drop plate assembly 51 prior to release into the underlying carton, packing station 27 includes four container stop assemblies 112. Each of these assemblies, as shown in FIGS. 14 and 15, consists of an end block 113 and a detection flag 114 pivotably mounted within a slot 115 opening toward the container-abutting end of the block. The four container stop assemblies 112 are supported by respective ones of four threaded support members 116 which are attached to a single transversely-extending support bar 117. The relative spacing between the container stop assemblies 112 and the common support bar 117 is adjustable by reason of the threaded support members 116 and it is contemplated that this spacing would be set during set-up of the packing machine to establish a desired pre-packing position for the lead containers abutting the stop assemblies in each row. The common support member 117 is connected to the actuator rod 118 of a pneumatic actuator 1 cylinder 120.

During operation of the machine, the container stop assemblies 112 are selectively positioned in either an extended container-receiving position, wherein they initially receive in an abutting relationship the leading ones of the containers 21*c* in each row or channel next to be packed as they advance onto the container set assembly 50, or in a retracted pre-packing position, wherein the leading containers again abut all of the containers 21*c* next to be packed are positioned in their pre-packing positions. Movement of the container stop assemblies 112 between these two positions is accomplished by selective actuation of cylinder 120, which causes the common mounting member 117 to be either extended or retracted, and hence each of the step assemblies 112 to be either extended or retracted.

The container detection flags 114 pivotably mounted in container stop assemblies 112 serve to ascertain whether the lead container in each row has reached its respective stop assembly. These flag members 114 are pivotably mounted so as to project immediately above the stop assemblies when no containers are abutting the blocks 113, and to project toward the side of blocks when a container is in abutment. The position of the four flag members, and hence the position of the lead bottles in each of the four rows of bottles, is sensed by means of a photocell 121 and a coacting light source 122. These elements are positioned on frame 23 such that light from source 122 shines on photocell 121 only when all flags project at an angle; which condition occurs only when containers abut all four of the container stop assemblies 112. Should any one of the rows of containers not abut its respective container stop assembly, the flag of that stop assembly is spring biased to extend vertically above the assembly as shown by the broken line in FIG. 14 and will prevent the light from source 122 from shining on photocell 121. Of course, other means, such as individual microswitches attached to each of the container stop assemblies 112, could be used to sense the position of the containers. In the latter instance the four switches could be normally-open types wired in series, so that only when containers abut all four assemblies would a closed circuit result and the packing cycle be allowed to continue.

Figure 18:
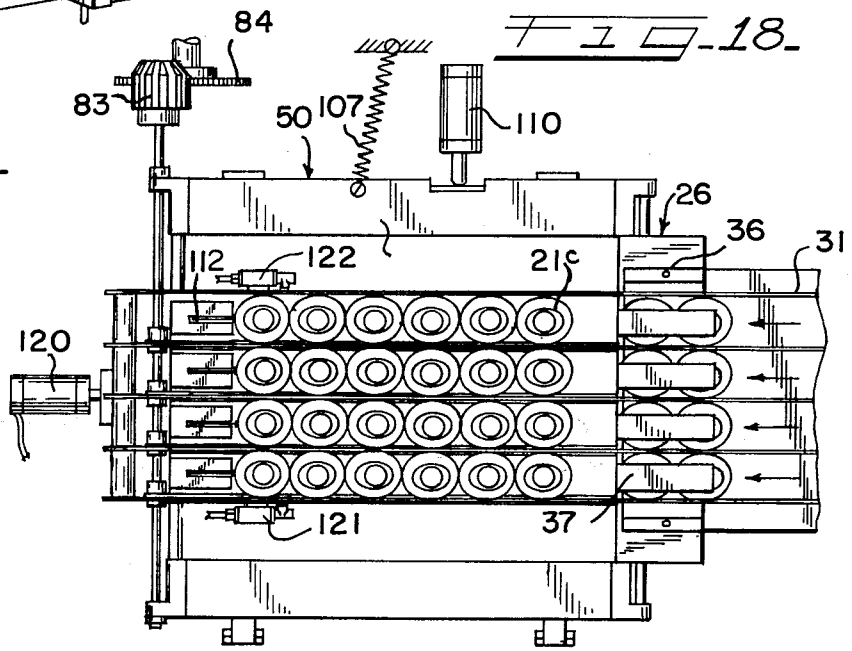
FIG. 18 is a top plan view of the container packing and clamping stations showing the position of containers to be packed during a third portion of the operating cycle.
Figure 16:
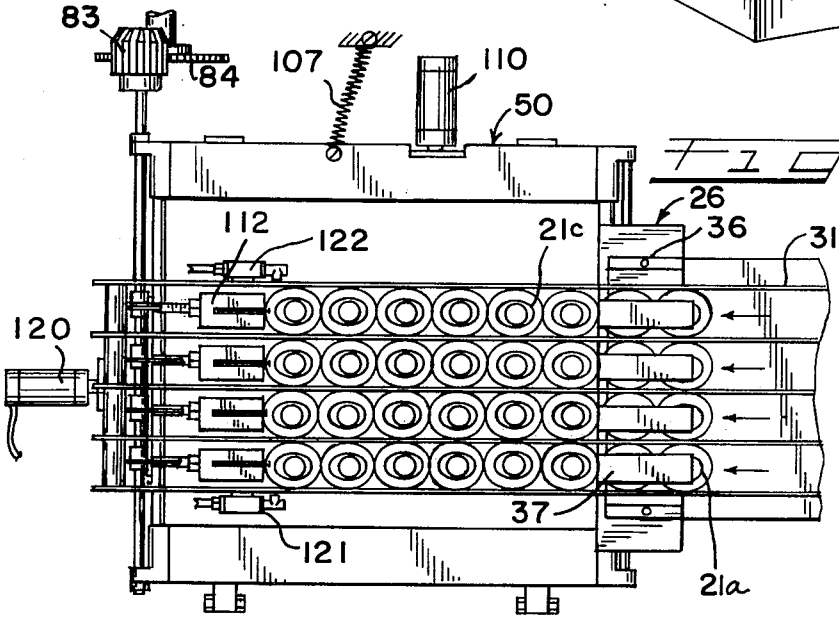
FIG. 16 is a top plan view of the container packing and clamping stations showing the position of containers to be packed during a first portion of the machine operating cycle.
Figure 17:
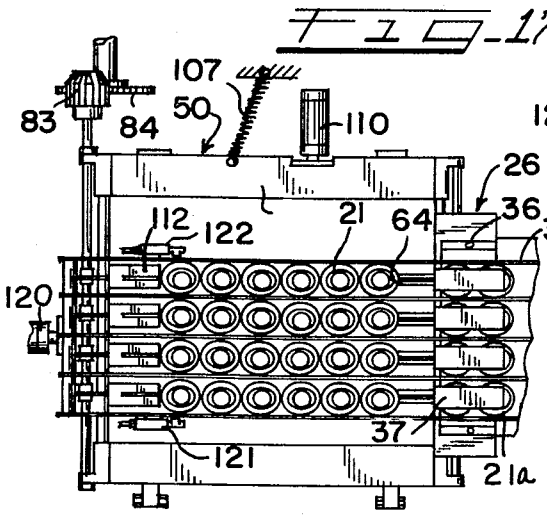
FIG. 17 is a top plan view of the container packing and clamping stations showing the position of containers to be packed during a second portion of the machine operating cycle.

Referring to FIGS. 16–18, during operation of the packing machine the containers 21 in each row are advanced by conveyor 24 through clamping station 26. As each container passes over the dead plate 36 in this station it becomes supported by a respective one of the four drive bar assemblies 64 and is urged forward toward stop assemblies 112. As shown in FIG. 16, this forward motion continues until all 24 containers 21*c* to be next packed have entered onto drop plate assembly 51. Stop assemblies 112 are extended at this time, and the extended positions of the stop assemblies are set so that the last container in each row will have cleared clamping station 26 as the lead containers in each row come into contact with the stop assembly 112 for that row. This contact causes the flag 114 associated with that stop assembly to be actuated. When all of the flags have been actuated, signifying that the lead container in each row in abutting the stop assembly for that row, the light beam between photocell 121 and its light source 122 is cleared and the control circuitry of the packing machine is conditioned to actuate cylinder 43 to restrain the trailing containers 21*a* and 21*b* in clamping station 26, and to actuate cylinder 120 to retract the four stop assemblies 112 from their container-receiving positions to their pre-packing positions. As shown in FIG. 17, retraction of these assemblies causes the 24 containers 21*c* next to be packed to be advanced under the influence of the underlying drive bar assemblies 64 to again abut the stop assemblies 112. The retracted positions of the stop assemblies 112 are carefully set such that the containers 21*c*, when abutting these assemblies, are in their desired pre-packing positions. It should be noted that the containers move into these positions solely under the influence of the underlying drive bar assemblies 64, since the trailing containers 21*a* still under the influence of the in-feed conveyor 24 are restrained at clamping station 26.

It is contemplated that in certain less-demanding packing situations the grouping of the containers next to be packed could be accomplished by other means. For instance, the container stop assemblies 112 could be set permanently in their pre-packing positions and operation of the container in-feed conveyor 24 could be interrupted by means of a clutch or other suitable means after the last container 21*c* in each row of the group next to be packed had cleared the conveyor as detected by a photocell or switch in conjunction with suitable counting circuitry. This arrangement would obviate the need for the stop assembly retraction cylinder 120 and the container clamping station 26.

Referring to FIG. 18, once the containers have assumed their pre-packing positions, cylinder 110 is actuated to cause the drop plate assembly 51 to shift forward until the drive bar assemblies 64 underlie the dividers 31 between the rows of containers. This allows the containers to fall from their pre-packing positions under the guidance of spring fingers 106 into the underlying carton 22*a*.

It will be appreciated that the re-positioning of the containers in the packing station 27 once clamping station 26 has been actuated is accomplished only as a result of the drive chains 68 on the drive bar assemblies 64, and not as a result of the motion of conveyor 24. It is this isolated controlled re-positioning of the containers accomplished by the powered drive chains 68 which achieves the improved packing speed and accuracy in in-line packing machines.

It is contemplated that it may be desirable in certain situations to stop the motion of the drive chains 68 during certain portions of the packing cycle, as when the container drop assembly 50 is being shifted, and electrical or mechanical means may be incorporated in the drive arrangement provided for the drive chains toward this end. It will be understood that the control and actuator systems for the packing machine of the present embodiment may be entirely conventional in design and construction, employing conventional switch and photoelectric sensors, and conventional pneumatic or hydraulic actuators. Accordingly, these systems have not been covered in detail herein. Furthermore, it will be understood that the packing machine is adaptable to a wide variety of containers, and as used herein the term containers is meant to include glass or plastic bottles, and metal cans of whatever shape or size.

Thus, a novel packing machine has been shown and described which provides improved packing accuracy and efficiency by reason of an improved container drop assembly which positions containers more quickly and accurately in pre-packing positions from which they can be dropped as a group into an underlying carton. The drop assembly can be readily removed and interchanged with other assemblies to facilitate rapid conversion of the packing machine from one type of container to another, and by reason of the novel drive chain assemblies utilized in the drop assembly to position the containers the packing machine is particularly well suited for packing thin-wall, flexible, odd-shaped or fragile bottles, wherein variations in the drive effort applied to the containers could result in misalignment deformation, or even breakage of the containers. With the present packing machine a uniform feed rate is maintained on the container drop assembly at all times, resulting in the consistent accurate positioning of even odd-shaped or thin-walled bottles for optimum packing efficiency.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. In an in-line packing machine of the type having a plurality of side-by-side channels in which containers to be packed are advanced, and a packing station for transferring containers from said channels to desired packing positions in an underlying carton, said packing station comprising a plurality of drop bar assemblies underlying respective ones of said container channels, said drop bar assemblies each including a continuous-loop drive chain presenting an upwardly-facing surface for frictionally engaging said containers, drive means for powering said drive chains to advance said containers in each of said channels to said predetermined packing positions, and release means for shifting said drive bar assemblies from positions under said channels to positions between said channels after said containers have arrived at said predetermined pre-packing positions to allow said containers to drop into said underlying carton, the improvement wherein:

each of said drop bar assemblies includes a support bar having a guide channel on the top surface thereof, the width of said support bar, overall, not exceeding the width of said drive chain, and wherein at least a portion of the links on said drive chain include a projecting tab portion slidably engaged in said guide channel.

2. A packing machine as defined in claim 1 wherein said tab portions are provided on alternate links of said drive chain.

3. A packing machine as defined in claim 1 wherein said drive chain consists of double connecting links and single drive links joined in alternation, and wherein said tab portions are provided on said single drive links.

4. A packing machine as defined in claim 1 wherein said drop bar assembly further includes a pair of chain support wheels at either end of said support bar, and wherein said support wheels are circumferentially toothed to engage said projecting tab portions of said chain links.

5. In an in-line packing machine of the type having a plurality of guide members defining side-by-side channels for conveying containers to be packed, a conveyor belt for advancing said containers along said channels, and a packing station for receiving said containers in a defined group from said conveyor and for transferring said containers from said channels to desired packing positions in an underlying carton, the packing station including a plurality of drop bar assemblies underlying and aligned with respective ones of said container channels, said drop bar assemblies each including a support bar, and a continuous loop drive chain presenting a support surface for frictionally engaging said containers in said packing station, drive means for powering said drive chains to advance said containers along said channels into predetermined pre-packing positions in said packing station corresponding to said desired packing positions in said underlying carton, positioning means including a plurality of container stop assemblies in respective ones of said channels for receiving said containers in abutting relationship, said stop assemblies having a pre-packing position such that the lead containers in each channel abut the stop assemblies when the containers in said group are in said predetermined pre-packing positions, and release means for shifting said drop bar assemblies from under said channels after said containers have advanced against said stop assemblies to allow said containers to drop into said underlying carton, the improvement wherein said support bars are narrower than said drive chain and said guide members, and include guide channels on the top surfaces thereof, and wherein at least a portion of the links of said drive chain include projecting alignment tab portions slidably received in said guide channels.

6. A packing machine as defined in claim 5 wherein said tab portions are provided on alternate links of said drive chain.

7. A packing machine as defined in claim 5 wherein said drive chain consists of double connecting links and single drive links joined in alternation, and wherein said tab portions are provided on said single drive links.

8. A packing machine as defined in claim 5 wherein said drop bar assembly further includes a pair of chain support wheels at either end of said support bar, and wherein said support wheels are circumferentially toothed to engage said projecting tab portions of said chain links.

9. In an in-line packing machine of the type having a plurality of side-by-side channels in which containers to be packed are advanced, and a packing station for transferring containers from said channels to desired packing positions in an underlying carton, said packing station comprising a plurality of drop bar assemblies underlying respective ones of said container channels, said drop bar assemblies each including a continuous-loop drive chain presenting an upwardly-facing surface for frictionally engaging said containers, drive means for powering said drive chains to advance said containers in each of said channels to said predetermined packing positions, and release means for shifting said drive bar assemblies from positions under said channels to positions between said channels after said containers have arrived at said predetermined pre-packing positions to allow said containers to drop into said underlying carton, the improvement wherein:

said drive bar assemblies comprise part of a drop plate assembly removable from said packing station, said drive means for powering said drive chains include a rotatably driven gear on the frame of said packing machine and a gear on said drop plate assembly operatively engaged thereto, and wherein one of said gears includes a beveled circumferential edge facing the other of said gears to facilitate engaging and disengaging said gears when inserting and removing said drop plate assembly from said packing station.

10. A packing machine as defined in claim 9 wherein said drop plate assembly is shifted to a position wherein said drive bar assemblies are positioned between said channels to drop said containers, and wherein said gear having said beveled edge is elongated with respect to said other gear to facilitate said shift in the position of said drop plate assembly.

11. In an in-line packing machine of the type wherein containers to be packed are advanced in side-by-side channels, a packing station for transferring containers from said channels to desired packing positions in an underlying carton, comprising, in combination:

a plurality of drop bar assemblies underlying respective ones of said container channels, said drop bar assemblies comprising part of a drop plate assembly removable from said packing station and each including a continuous loop drive chain or belt presenting an upwardly-facing surface for frictionally engaging said containers, drive means for powering said drive chains or belts to advance said containers in each of said channels to said predetermined packing positions, and release means for shifting said drop plate assembly to remove said drive bar assemblies from positions under said channels after said containers have arrived at said predetermined pre-packing positions to allow said containers to drop into said underlying carton, the improvement wherein:

said drive means include a rotatably driven drive gear on the frame of said packing machine and a spur gear on said drop plate assembly operatively engaged thereto, one of said gears having a beveled circumferential edge facing the other of said gears to facilitate engaging and disengaging said gears when inserting and removing said drop plate assembly.

12. A packing machine as defined in claim 11 wherein said drop plate assembly is shifted to a position wherein said drive bar assemblies are positioned between said channels to drop said containers, and wherein said gear having said beveled edge is elongated with respect to said other gear to facilitate said shift in the position of said drop plate assembly.

* * * * *